US005137340A

United States Patent [19]

Cugley et al.

[11] Patent Number: 5,137,340

[45] Date of Patent: Aug. 11, 1992

[54] MERCHANDISING DISPLAY AND LOCATOR SYSTEM FOR FASTENER PRODUCTS

[75] Inventors: Derwyn Cugley, Brea; Thomas L. Evans, Laguna Nigel, both of Calif.

[73] Assignee: Vsi Fasteners, Inc., Stanton, Calif.

[21] Appl. No.: 688,900

[22] Filed: Apr. 19, 1991

[51] Int. Cl.[5] ..... A47B 88/00

[52] U.S. Cl. ..... 312/234.5; 312/111; 312/107

[58] Field of Search ..... 312/234.1, 107, 320, 312/234.5, 330.1, 111; 40/325

[56] References Cited

U.S. PATENT DOCUMENTS

| | | | |
|---|---|---|---|
| 810,294 | 1/1906 | Meaker | 312/330.1 |
| 1,289,363 | 12/1958 | Baynes | 312/320 |
| 1,993,477 | 3/1935 | Gourley et al. | 312/320 X |
| 2,482,174 | 9/1949 | Hake | 312/330.1 |
| 2,739,026 | 3/1956 | Moore | 312/320 |
| 3,003,839 | 10/1961 | Bloom et al. | 312/320 X |
| 3,022,595 | 2/1962 | Ribbens et al. | 40/325 |
| 4,640,560 | 2/1987 | Blum | 312/234.1 |

*Primary Examiner*—Joseph Falk
*Attorney, Agent, or Firm*—Frederick Gotha

[57] ABSTRACT

A merchandising display and locator system for enhancing the visual access of a purchaser to fastener product information. A box-shaped housing having a truncated frontal surface contains a plurality of tray members which have an angularly projecting frontal flange to permit enhanced visual access by a purchaser. An information card is provided with the display which contains graphical representations of fastener indicia such as thread styles, head styles, drive styles, nuts and washers. In association with the graphical representations are the trade names of these indicia. A product listing of trade names appears on the information card and an alphabetical code symbol is associated with each trade name. The appropriate code symbol appears on the frontal flange of the tray member carrying the particular fastener product having that trade name identification.

19 Claims, 14 Drawing Sheets

Fig. 12A

| | DRAWER |
|---|---|
| **ALUMINUM** | |
| STORM DOOR FASTENERS-ALUMINUM | A |
| **BRASS** | |
| FLAT HEAD MACHINE SCREWS-BRASS-4-40 & 6-32 | B |
| **METRIC** | |
| HEX CAP SCREWS-METRIC 8 & 10 MM(FINE THREAD | C |
| HEX CAP SCREWS-METRIC 4 & 5 MM | D |
| HEX CAP SCREWS-METRIC 6 MM | E |
| HEX CAP SCREWS-METRIC 8 MM | F |
| HEX CAP SCREWS-METRIC 10 MM | G |
| HEX CAP SCREWS-METRIC 12 MM | H |
| HEX CAP SCREWS-METRIC 16 MM | I |
| SOCKET HEAD CAP SCREWS-METRIC 3,4 & 5 MM | J |
| SOCKET HEAD CAP SCREWS-METRIC 6,8 & 10 MM | K |
| NUTS & LOCK WASHERS-METRIC | L |
| WASHERS-METRIC | M |
| **MISCELLANEOUS** | |
| THUMB SCREWS W/O SHOULDER | N |
| DOWEL SCREWS & HANGER BOLTS | O |
| **ELECTRICAL** | |
| SWITCH PLATE SCREWS | P |
| **PINS** | |
| COTTER PINS (EFF) | Q |
| COTTER PINS-MARINE | R |
| CLIPS-HAIRPIN & HITCH PIN | S |
| UNIVERSAL CLEVIS PINS | T |
| TENSION PINS | U |
| **RINGS & HOOKS** | |
| RETAINING RINGS-EXT. & "E" | V |
| LARGE RETAINING RINGS-EXT. & INT | W |
| **RIVETS** | |
| RIVETS-BURRS, COPPER & TINNERS | X |
| RIVETS-SPLIT & TUBULAR | Y |
| **KEYS** | |
| WOODRUFF KEYS | Z |
| SQUARE KEY STOCK | AA |

Fig. 12B

STAINLESS STEEL

FLAT HEAD MACHINE SCREWS-STAINLESS STEEL-4-40,6-32,8-32 ..... AB
FLAT HEAD MACHINE SCREWS-STAINLESS STEEL-10-24,10-32, 1/4-20 ..... AC
OVAL HEAD MACHINE SCREWS-STAINLESS STEEL-4-40,6-32,8-32 ..... AD
OVAL HEAD MACHINE SCREWS-STAINLESS STEEL-10-24,10-32,1/4-20 ..... AE
ROUND HEAD MACHINE SCREWS-STAINLESS STEEL-4-40,6-32,8-32 ..... AF
ROUND HEAD MACHINE SCREWS-STAINLESS STEEL-10-24,10-32,1/4-20 ..... AG

NUTS-STAINLESS STEEL-STOP, CAP & WING ..... AH

FLAT HEAD PHILLIPS SHEET METAL SCREWS-STAINLESS STEEL ..... AI
OVAL HEAD PHILLIPS SHEET METAL SCREWS-STAINLESS STEEL ..... AJ
PAN HEAD PHILLIPS SHEET METAL SCREWS-STAINLESS STEEL ..... AK

STEEL

SOCKET HEAD CAP SCREWS SAE-4-40, 6-32, 8-32 ..... AL
SOCKET HEAD CAP SCREWS SAE-1/4, 5/16, 3/8, 7/16, 1/2 ..... AM
SOCKET HEAD CAP SCREWS SAE/USS-10-24, 10-32 ..... AN
SOCKET HEAD CAP SCREWS USS-1/4 ..... AO
SOCKET HEAD CAP SCREWS USS-5/16 ..... AP
SOCKET HEAD CAP SCREWS USS-3/8 ..... AQ
SOCKET HEAD CAP SCREWS USS-1/2 ..... AR

SOCKET HEAD SET SCREWS-CUP POINT SAE ..... AS
SOCKET HEAD SET SCREWS-CUP POINT USS ..... AT

HEX CAP SCREWS GRADE 5 SAE-1/4 ..... AU
HEX CAP SCREWS GRADE 5 SAE-5/16 ..... AV
HEX CAP SCREWS GRADE 5 SAE-3/8 ..... AW
HEX CAP SCREWS GRADE 5 SAE-7/16 ..... AX
HEX CAP SCREWS GRADE 5 SAE-1/2 ..... AY

SPEED NUTS AZ

LOCK WASHERS - TOOTH ..... BA
NEOPRENE RUBBER WASHERS ..... BB

MERCHANDISING DISPLAY AND LOCATOR SYSTEM FOR FASTENER PRODUCTS

FIELD OF THE INVENTION

This invention relates to a merchandising display and locator system for fasteners for use primarily in the merchandising of fasteners in home centers, hardware stores, and lumber yards.

BACKGROUND OF THE INVENTION

The merchandising of fasteners in home centers, hardware stores, and lumber yards is directed toward presenting the fastener product to the consumer for easy access and purchase. The fastener products are displayed and packaged in cabinets, bins, plastic see-through bags, boxes and combination displays which require the efficient utilization of merchandising space. Display bins, packages, and drawers generally have product information and the identification of the fastener product contained on labels which are affixed thereto. The bins, bags, boxes, or drawers comprise the merchandising system and their utilization requires the purchaser to locate the particular type of fastener he intends to purchase by examining the labels associated with each bin, plastic bag, cabinet or box. To accommodate the consumer for easy selection of a fastener product, merchandising systems utilize color codes, illustrations, and graphics to communicate information to the consumer which are designed to facilitate his selection of a fastener product. In attempting to efficiently utilize merchandising space for the presentation and storage of fastener products, the merchandiser of necessity, stores the product in essentially vertical displays extending upward from the floor level and consequently product information is widely distributed. Thus, to receive product information the consumer must read labels which are associated with each individual product and presented with that product in an essentially vertical plane. Products which are stored at or near floor level are not easily identifiable because the consumer must either bend down or kneel in order to read the information contained on the label.

SUMMARY OF THE INVENTION

There is, therefore, provided according to the present invention, a merchandising system for organizing, displaying and dispensing fastener products to the consumer which allows the merchandiser to maximize product visibility, maximize the use of available merchandising space, and to simplify inventory control while simplifying the selection process for the purchaser.

The present invention is directed to a merchandising system which is composed of a series of merchandising display modules where each module has a housing which is substantially box-shaped and has a truncated frontal surface such that the front face of the housing is sloped rearwardly at an angle of approximately 9 degrees which permits visual access to more product and more clearly exposes labels to the purchaser. The box-shaped housing has a pair of substantially parallel sidewalls, a base member, and a cover panel substantially parallel to the base member. A plurality of slots extend longitudinally on the inside surface of the sidewall and are vertically spaced to accommodate a plurality of tray members which are adapted for slideable movement with respect to the housing. Each tray has a planar frontal flange which extends downwardly from the front of the tray at an angle of approximately 40 degrees with the vertical which provides easy visibility of the label information contained on the angularly projecting frontal flange. A series of stops are of the slots contained in the inside surface of the sidewall members and are staggered vertically along a preselected slope so as to allow the tray which is located on the lowest portion of the module to project a greater distance longitudinally from the front surface of the housing then the next upper tray. This permits greater visual access to graphical illustrations and product information contained on the sloped frontal flanges of the plurality of trays by the purchaser.

The modules are tiered vertically and also horizontally by contiguously mating a sidewall to a sidewall and a cover panel to a base member. The mating of the contiguous sidewalls is achieved by a plurality of receptor cavities disposed in one of the mating sidewalls and a plurality of projections extending from the other mating sidewall. In this way the modules may be mated together horizontally and vertically to efficiently utilize the merchandising space for presentation of the fastener products.

In another embodiment of the merchandising display, a plurality of bin trays are carried by the box-shaped housing. In this embodiment a plurality of planar support surfaces extend laterally between the opposing sidewall slots to form the support surface of the bin trays. The bin trays have a frontal flange member which projects angularly downwardly at an approximate angle of 40 degrees with the vertical thereby presenting a surface of greater visibility access to the purchaser. The bin trays project at decreasing horizontal distances from the frontal surface of the housing in the direction from the base member of the box-shaped module to the cover panel. Greater visibility of the product contained within the bin tray is achieved through truncating the sidewall members of the tray by an angular plane which slopes rearwardly from the frontal flange over approximately ⅓ of the length of the sidewall member.

A coded locator card for easy identification and location by the customer of fastener products is used in conjunction with the merchandising display of this invention. At the point of purchase, the information card is available to the purchaser and graphically illustrates head styles, drive styles, thread styles, nuts, washers and specialty type fasteners. By referring to the identification card the purchaser must perform the mental step of identifying the graphically displayed type of fastener he wishes to purchase. Below the graphic representation is the common trade name of that particular fastener product. A fastener product listing is contained on the information card from which the purchaser after having identified the trade name of the fastener finds an alphabetical code which identifies the particular tray in which the fastener product is stored. Although an alphabetical code may be used to identify the tray, a numerical code may also be associated with each particular type of fastener or a combination of numerical and alphabetical characters may be selected for tray or bin tray identification.

The merchandisor by use of the locator system of this invention simplifies inventory control and restocking. To restock the tray with fastener products, the merchandiser orders fasteners from the supplier by referring to the code appearing on the tray for identification of the product to be restocked. The supplier is in possession of the locator system information card and identifies the product shipment by the merchandiser's code.

BRIEF DESCRIPTION OF THE DRAWINGS

These and other features and advantages will become appreciated as the same become better understood with reference to the following specification, claims and drawings wherein:

FIGS. 12A and 12B are illustrations of the product listing contained on the fastener locator system information card and the tray or tray-bin code associated with each type of fastener product.

DETAILED DESCRIPTION

Figure 1:
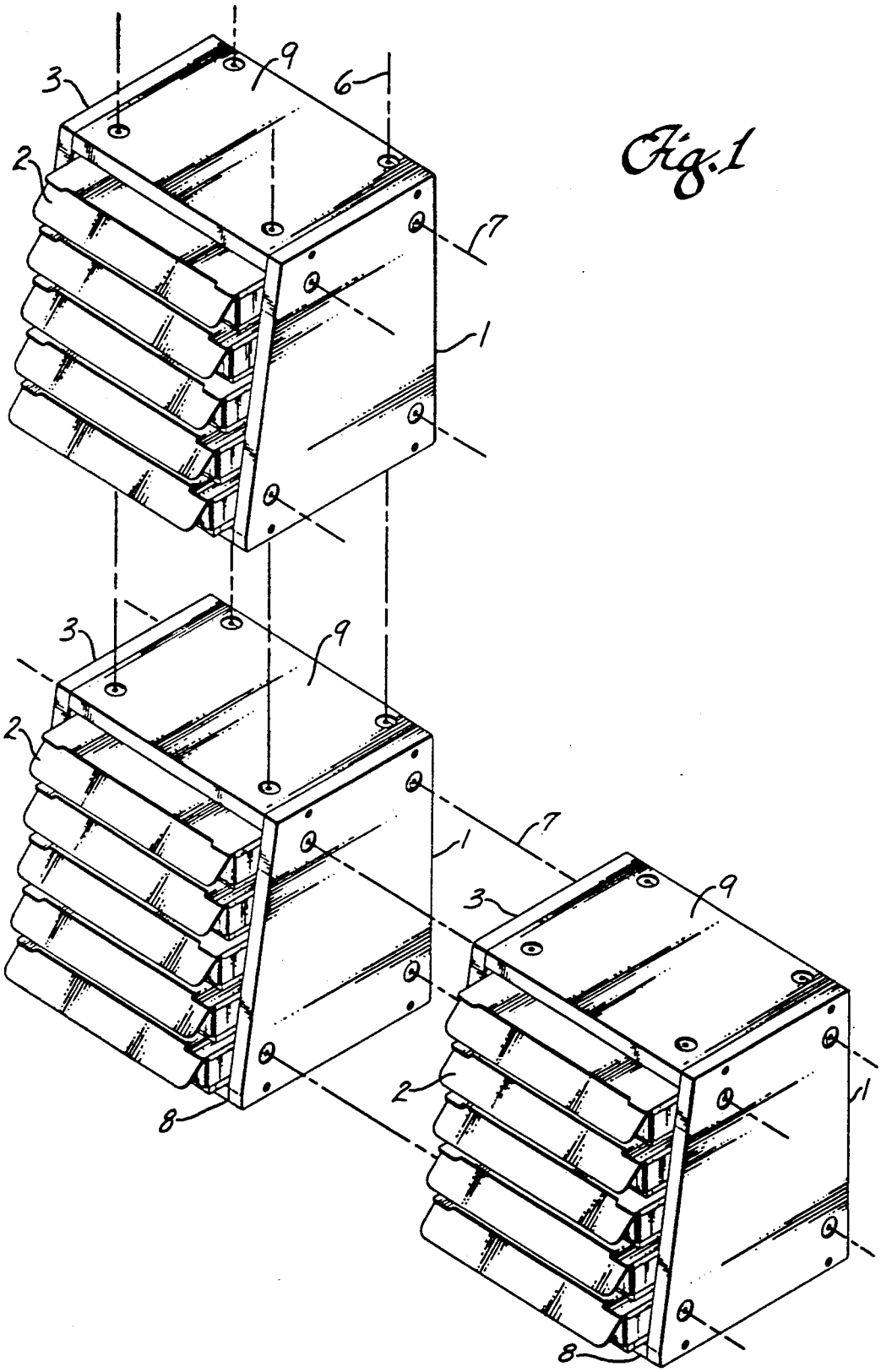
FIG. 1 is a perspective view of a plurality of merchandising display devices illustrating the modular horizontal and vertical tiering of the devices.

Referring to FIG. 1, an assembly 1 is shown of a merchandising display device in modular form having a multiplicity of trays 2 which are adapted for slideable movement and carried by the housing 3. Housing 3 has a plurality of vertical tiering axis 6 and a plurality of horizontal tiering axis 7. As can be seen in FIG. 1, the display device modules 1 can be releasably locked together in both a vertical and horizontal direction to maximize the merchandising space available for the display of fastener products.

Figure 11A:
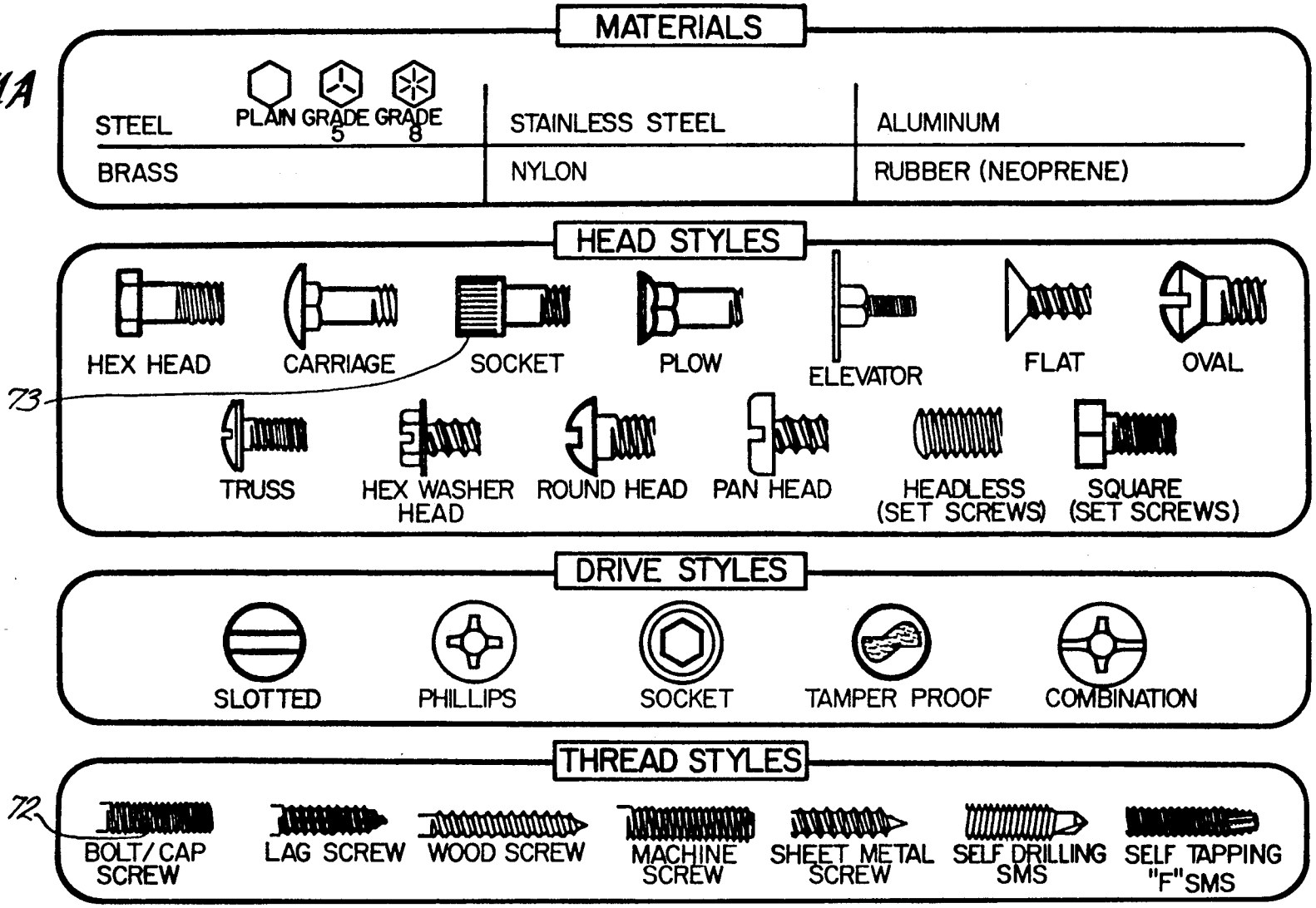
FIG. 11A illustrates the graphic information and fastener identifying information contained on the information card of the fastener locator system.
Figure 11B:
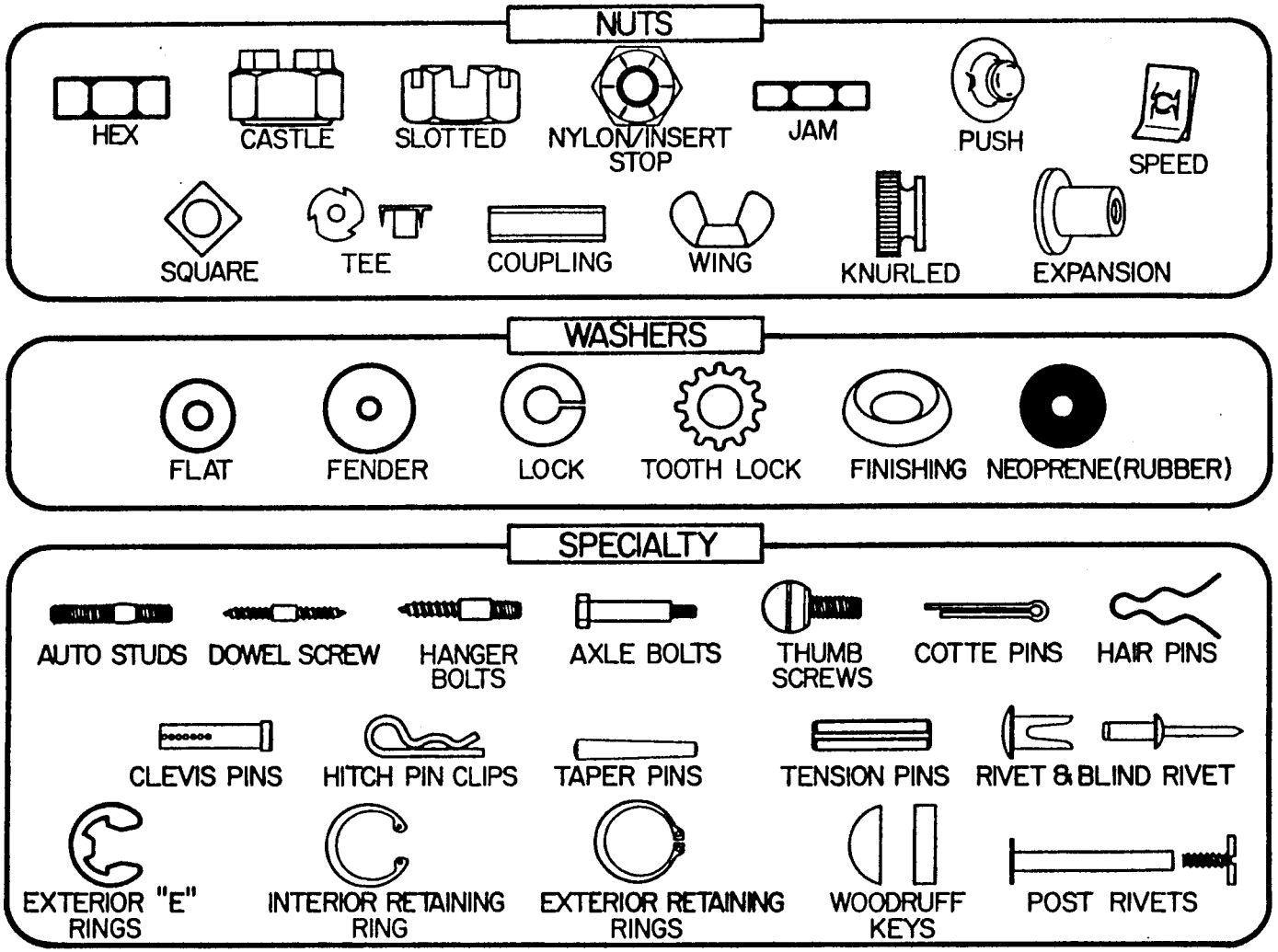
FIG. 11B depicts the graphic information and fastener identifying information contained on the information card of the fastener locator system.

Examples of the various types fastener products which are individually stored in each tray 2 are graphically illustrated in FIGS. 11A and 11B.

Figure 3:
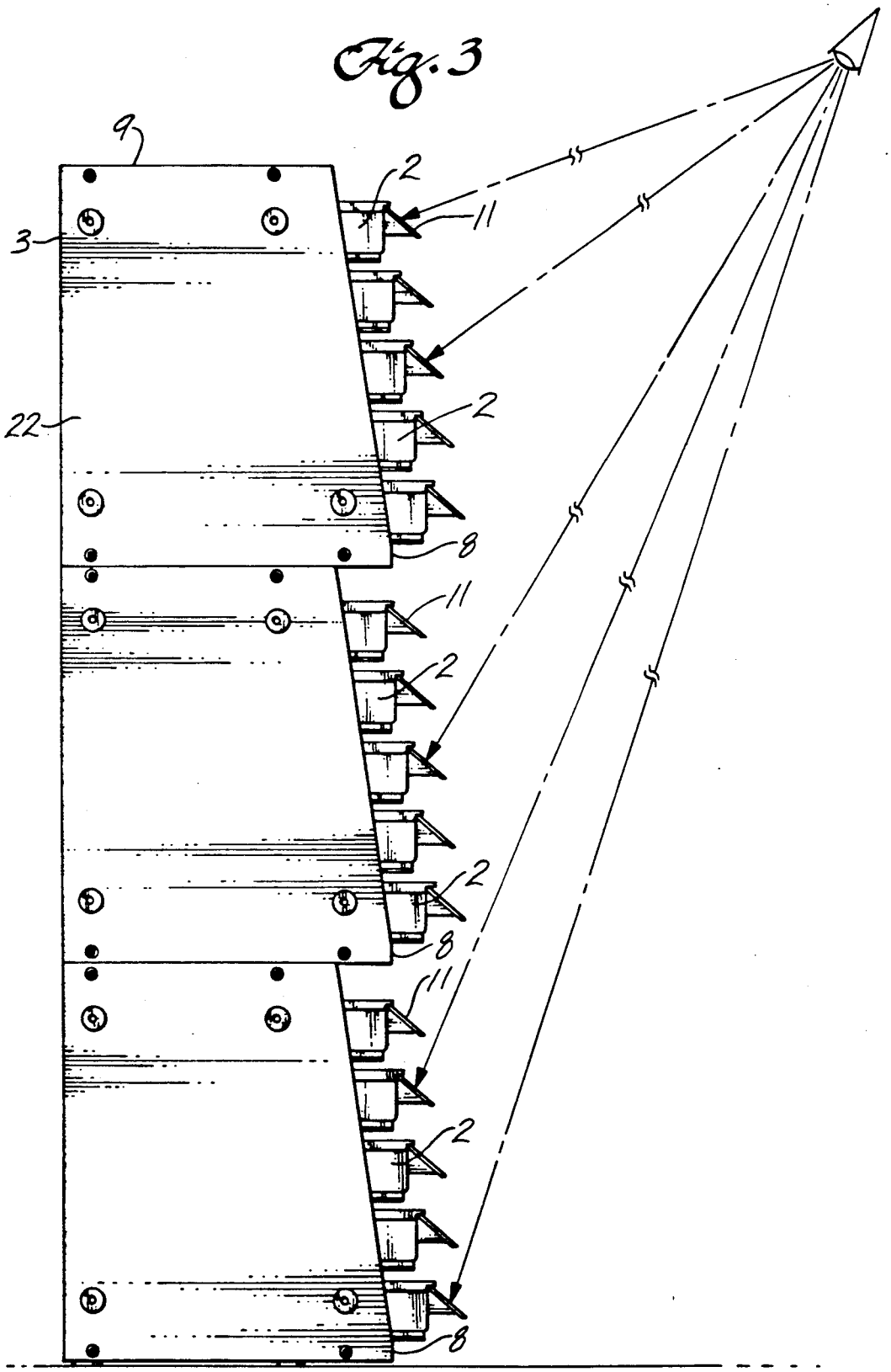
FIG. 3 is a side view depicting the modular vertical tiering of the merchandising display devices and illustrating the easy visual access of display information.
Figure 4:
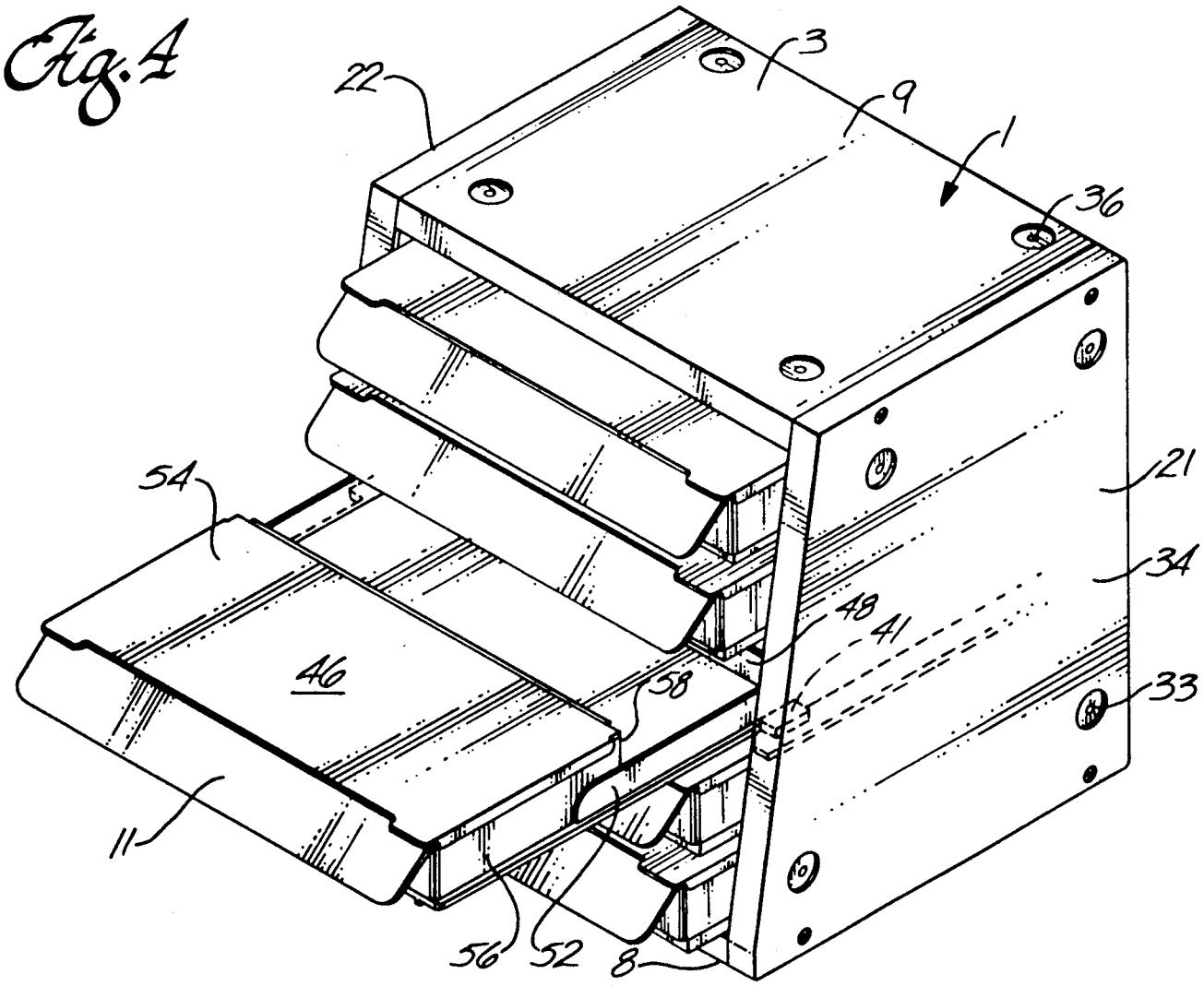
FIG. 4 is a perspective view of a merchandising display device with an extended tray.

A side view of vertically tiered merchandising display devices is shown in FIG. 3. It can be seen that the trays 2 in each merchandising display device module extend horizontally from housing 3 in successively shorter horizontal distances in the direction from the base member 8 of the housing vertically toward cover panel 9 of the housing 3. This permits ready visual access to each angularly extending flange 11 of tray 2 as the eye descends from the top most vertical angularly extending flange 11 adjacent cover panel 9 to the tray 2 which is located adjacent base member 8 of a housing 3.

Figure 8:
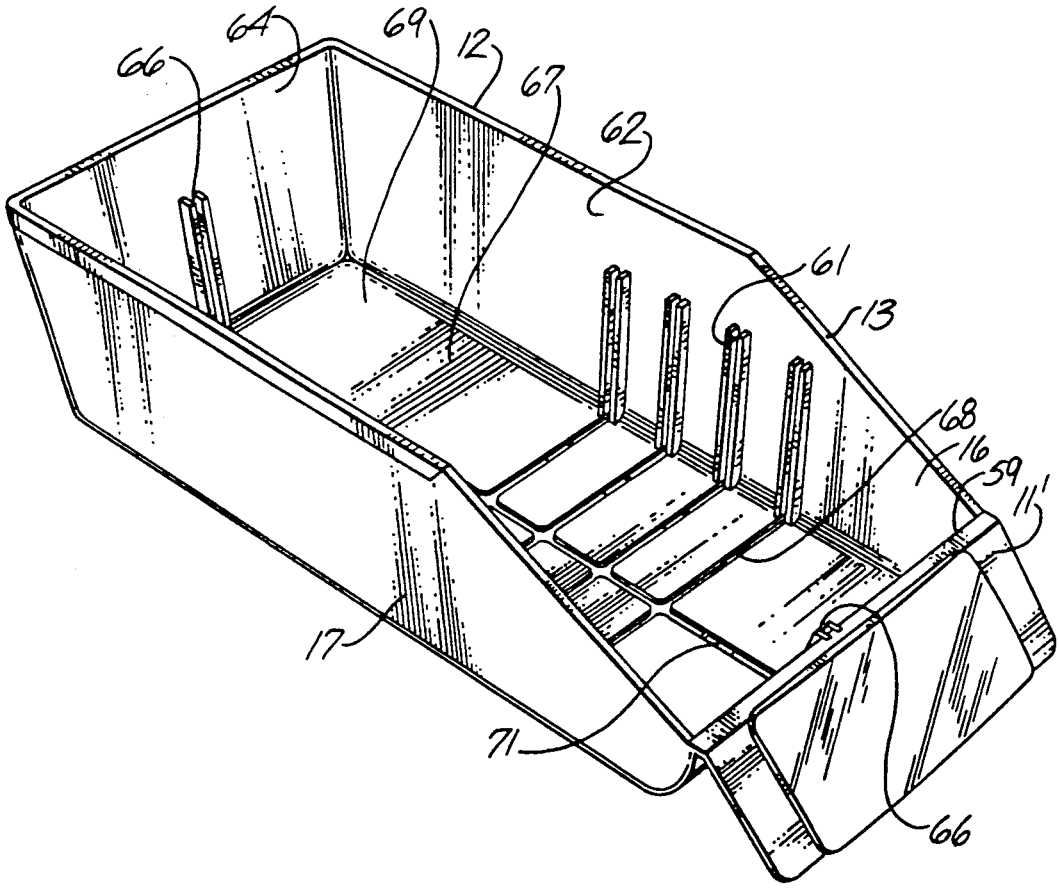
FIG. 8 is a perspective view of the bin-tray embodiment of this invention.
Figure 9:
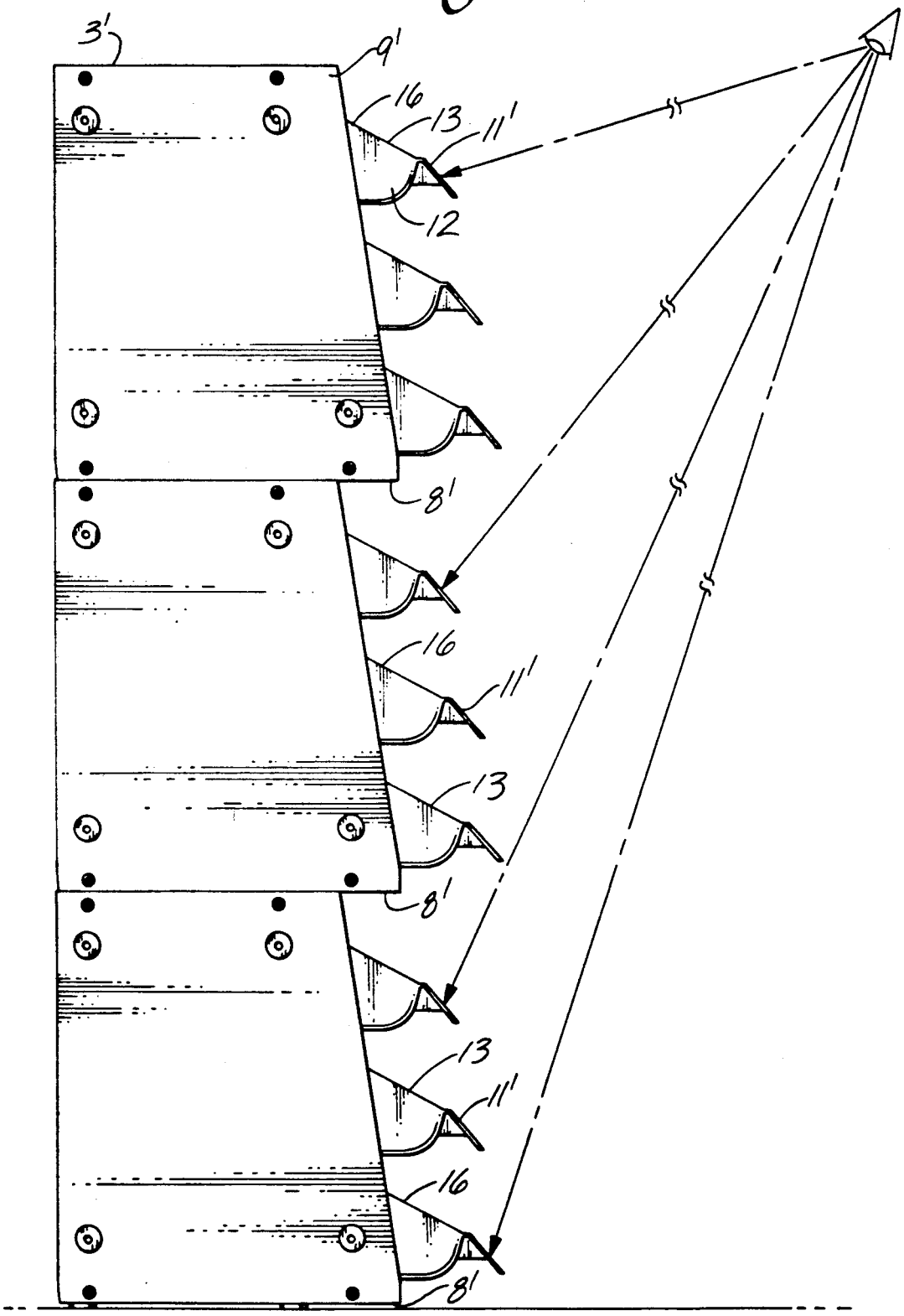
FIG. 9 is a side view depicting the vertical modular tiering in an embodiment utilizing bin-trays.

Similarly, as shown in FIG. 9, another embodiment of the merchandising display is illustrated having a bin-tray 12 which is slideably carried by the housing 3'. Housing 3' carries a multiplicity of bin-trays 12 which also extend horizontally from the housing in successively greater horizontal distances in a direction decreasing vertically from cover panel 9' to the base member 8'. Thus, fastener product information contained on angularly extending flange 11' is conveniently accessible to the customer. Greater visibility is also provided of the fastener products carried in bin-tray 12 by the truncation of the bin-tray forming the slope 13 at the display end 16 of the bin-sidewall 17. A perspective of the bin-tray is shown in FIG. 8 illustrating the truncation of the bin-sidewall members 17 to create frontal slope 13 at the display end 16 of the bin-tray.

Figure 2:
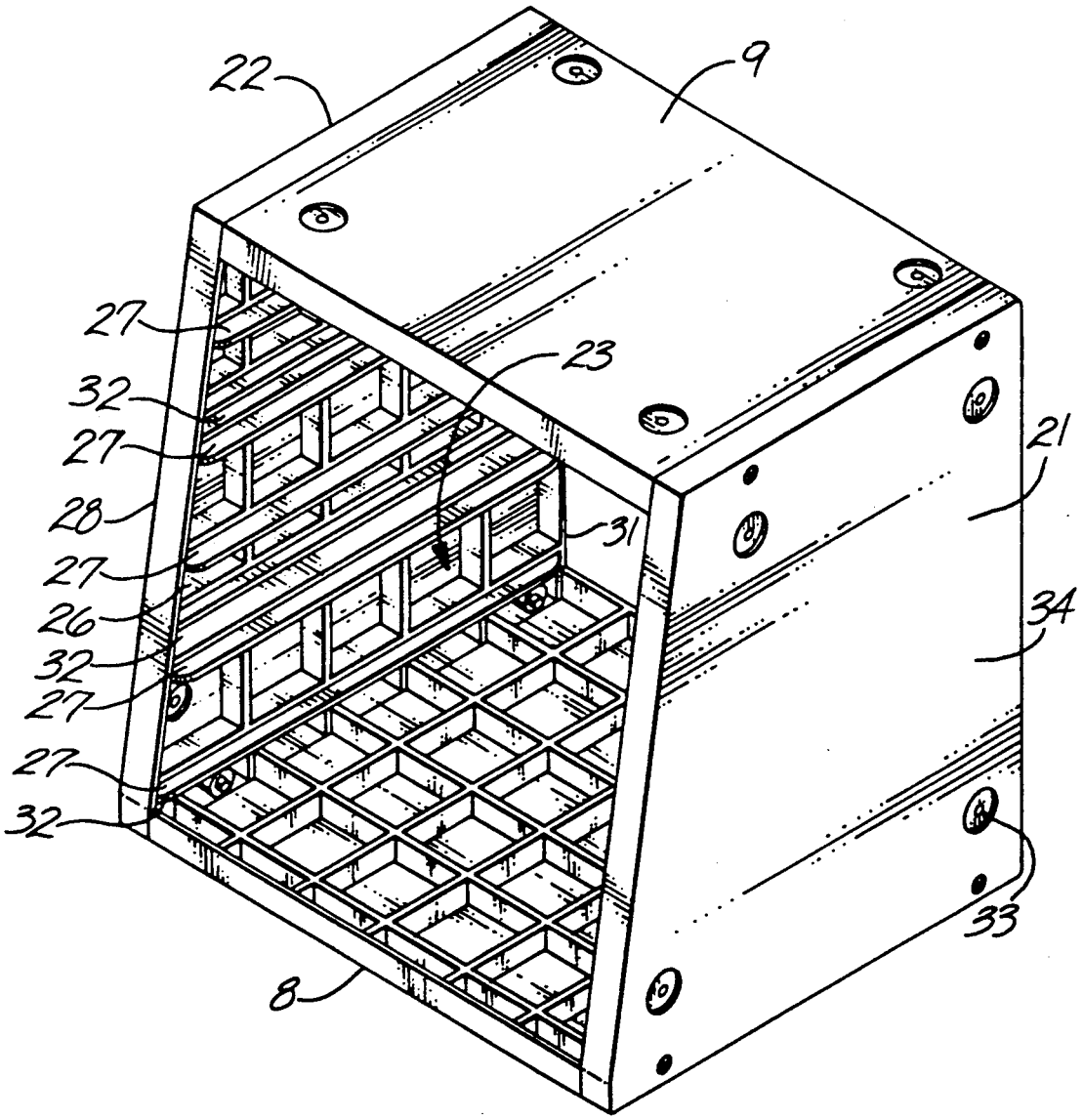
FIG. 2 is a perspective view illustrating the interior of the substantially box-shaped housing of this invention.

Referring now to FIG. 2, housing 3 is shown in a perspective view where it can be seen that housing 3 is a truncated box-shaped structure having essentially parallel sidewalls 21 and 22 which attach to cover panel 9 and base member 8 to form the box-shaped housing. Left sidewall 21 is a mirror image of right sidewall 22. The housing 3 contains a cavity 23 which is bounded by the inside surfaces of sidewall members 21 and 22, cover panel 9 and base member 8. Inside surface 26 of right sidewall 22 is illustrated in FIG. 2 and it can be seen that inside surface 26 is composed of a series of horizontal slots 27 which extend axially from the truncated frontal edge 28 of sidewall 22 to its rear or trailing edge 31. In the embodiment of the housing where the bin-trays 12 are carried by the housing, a plurality of planar support panels (not shown) provide a support surface for the bin trays and are mounted to the housing by insertion into the longitudinally extending channels 32 contained in inside surface 26 of right sidewall member 22 and left sidewall member 21. The lower most slot 27 and the lower most longitudinally extending channel 32 coincide and are structurally identical.

To accommodate the vertical and horizontal tiering of the modules or display devices 1, a plurality of receptor cavities 33 are located in the outside surface 34 of each left sidewall 21 and a plurality of receptor cavities 36 are located in each outside surface 37 of cover panel 9. Although not show in the figures, sidewall 22 has a plurality of projecting connectors for insertion into receptor cavities 33 to provide for a releasible locking of the modules or display devices 1 for tiering in the horizontal direction. Similarly, for tiering in the vertical direction, base member 8 has a plurality of projecting connectors which are located for mating with receptor cavities 36 in outside surface 37 of cover panel 9. The projecting connectors and receptor cavities when engaged provide a releasible lock to tier the modules or display devices 1 in a vertical direction.

Figure 6:
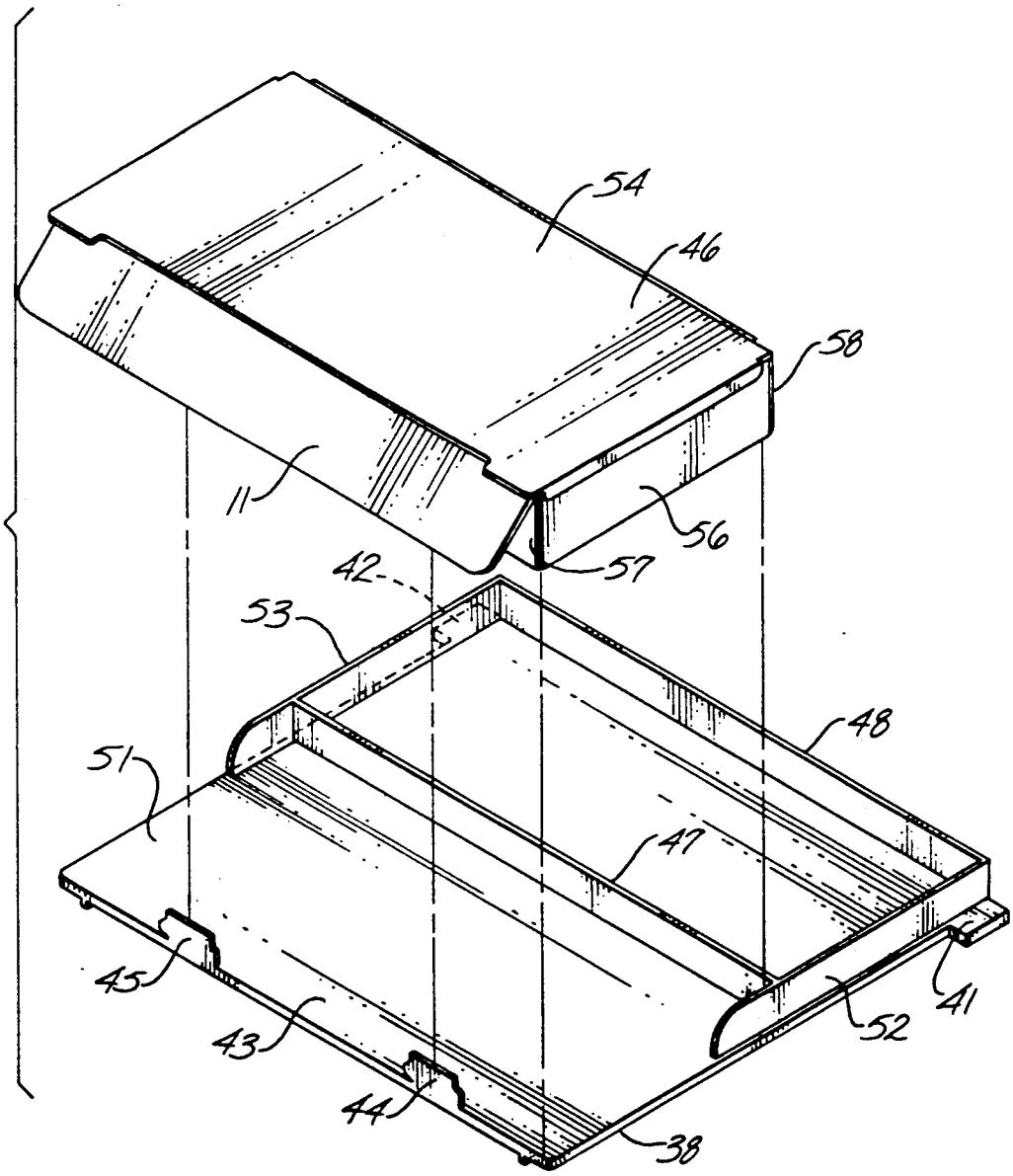
FIG. 6 is an exploded perspective view of the tray.

Referring to FIG. 6, tray 2 is more particulary illustrated in the exploded perspective view as shown in the figure. As can be seen in FIG. 6, tray 2 has a tray base 38 and a pair of laterally extending shoulders 41 and 42 which, when the tray is mounted in housing 3, engage longitudinally extending slots 27 in right and left sidewalls 22 and 21 respectively. Shoulders 41 and 42 bear against the lower supporting flange of slot 27 along with the lateral extremity of tray base 38 to support the tray for horizontal movement relative to the housing 3. A carriage region 43 of tray base 38 receives tray-container 46 which is mounted to the tray base by latches 44 and 45 which clip into tray container 46 and releasably hold the tray container to the tray base. Reinforcing ribs 47 and 48 are integrally carried by tray base 38 and extend laterally across its upper surface 51. Spars 52 and 53 are integrally formed in the upper surface 51 of the tray base and extend horizontally from shoulders 41 and 42 in the direction of latches 44 and 45 along the periphery of tray base 38. The intersection of rib 47 with spars 52 and 53 forms the rear portion of the carriage region 43 into which tray container 46 is inserted for carriage by the tray base 38.

Figure 10:
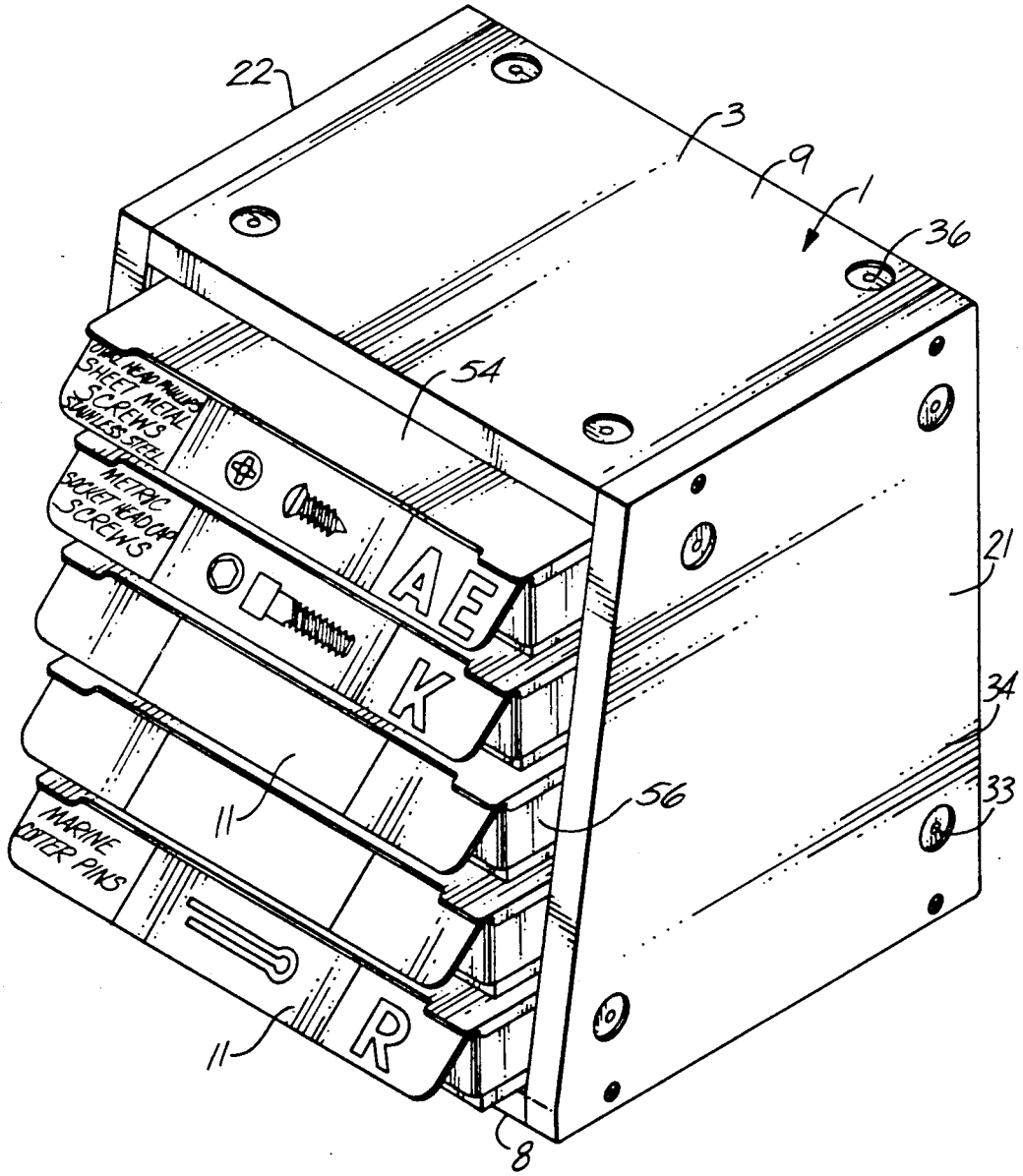
FIG. 10 is a perspective view of the merchandising display device of this invention illustrating the identification of the fastener locator system of this invention.

Although not shown in an open condition, tray container 46 is a thin walled container having a cavity enclosed by tray cover 54, tray-sidewalls 56 and front wall 57 and rear wall 58. Tray-cover 54 is pivotally connected to tray-rearwall 58 such that by lifting angularly extending flange 11 the consumer gains access to the storage region of the tray. Angularly extending flange 11 extends at an angle of approximately 40 degrees from the tray front wall 57 and is integrally attached to the front wall. By mounting angularly extending flange 11 at an angle to the front wall of the tray, visual access is provided to an observer of the projecting surface of the angularly extending flange 11. As can be seen in FIG. 10 this permits the presentation of graphical and descriptive information which assists the purchaser in selecting a particular type of fastener product.

Figure 5:
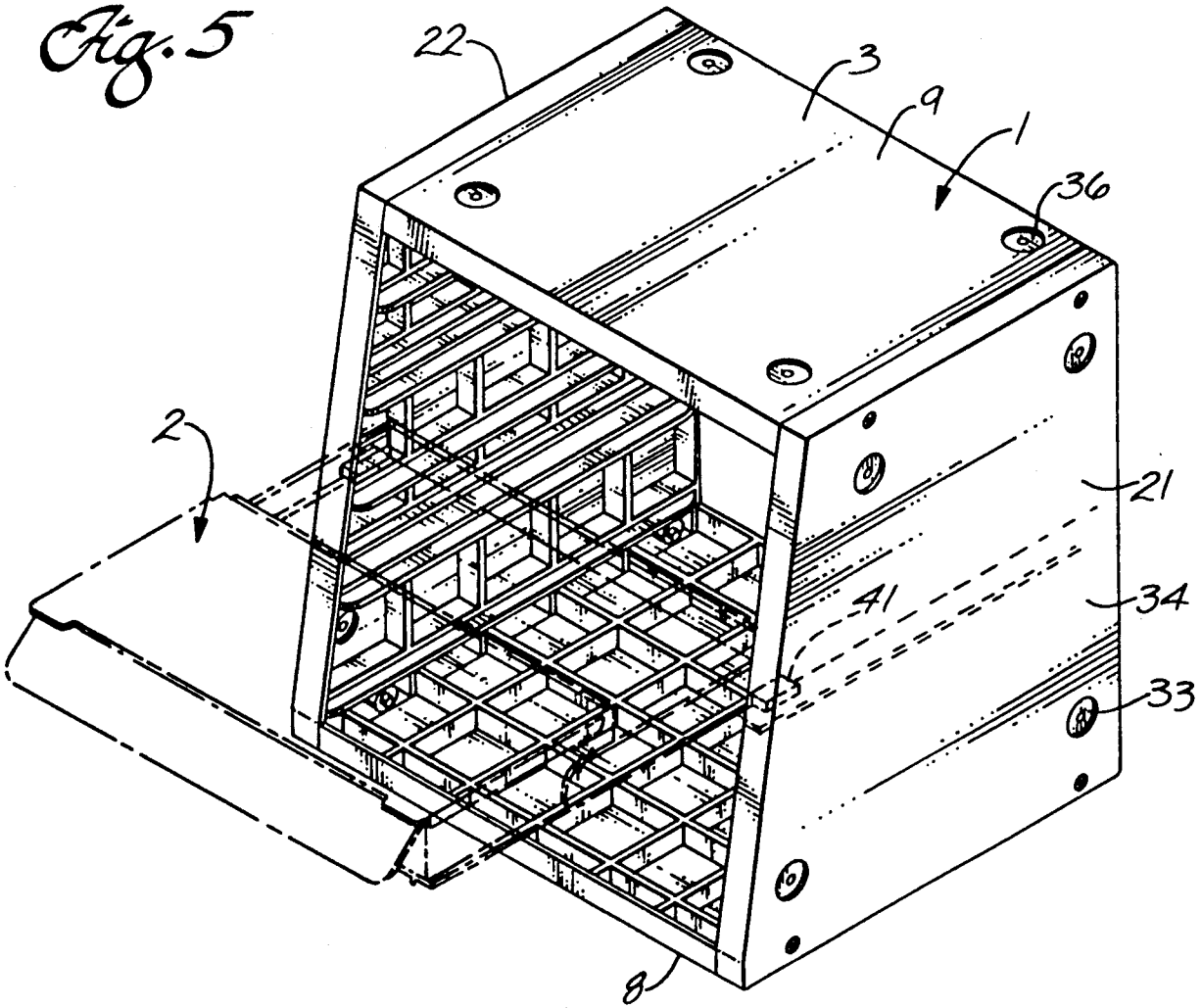
FIG. 5 is a perspective view of the box-shaped housing of this invention illustrating the interior of the housing and the tray carriage by the housing.

Referring now to FIG. 5, tray 2 is shown in phantom extending from a housing 3 with shoulders 41 and 42 extending into horizontal slots 27 to permit horizontal movement of the tray with respect to housing 3.

Figure 7:
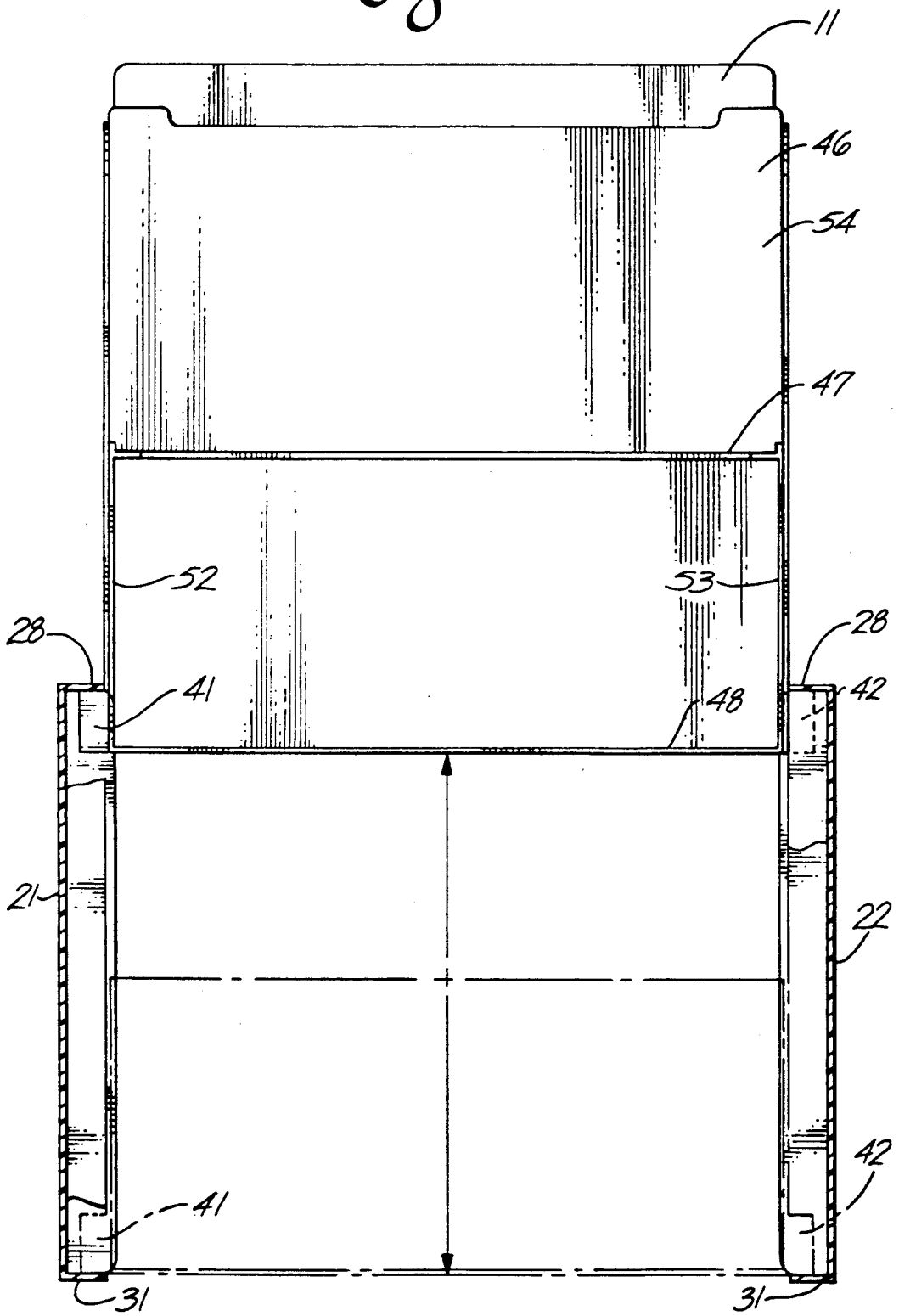
FIG. 7 is a top view of the tray extending from the housing which is illustrated in partial cross-sectional view.

In FIG. 7, a top view of tray 2 is shown with the housing in partial cross-section. It can be seen in FIG. 7 that tray base 38 has been horizontally extended and that further horizontal movement is precluded by the bearing of shoulders 41 and 42 against the truncated front edge 28 of the housing. In the stored position within the housing, shoulders 41 and 42 abut against the rear or trailing edge 31 of the housing.

In the embodiment of bin-tray 12 which is shown in FIG. 8, it can be seen that in the interior region of the tray, a plurality of vertical slots 61 are contained integrally on the inside surface 62 of bin-sidewalls 17. Each of the sidewalls 17 contain vertical slots 61 which are oppositely spaced on the opposing sidewalls 17 for receiving a partition member (not shown) which may be inserted into the slots to create a storage region at the display end 16 of bin-tray 12. The inside frontal surface 63 of bin-trays 12 and the inside rear surface 64 of bin-tray 12 contain separator slots 66 which are integrally formed on the inside surfaces to receive a separator partition (not shown) to conveniently divide the bin-tray into two regions. Bin-tray bottom wall 67 has a plurality of laterally extending troughs 68 in the inside surface of bottom wall 67 which communicate with vertical slots 61 for securing the partition to the inside surface 69 of bottom wall 67. Similarly, longitudinally extending trough 71 communicates with separator slots 66 for receiving a separator partition when it is desirable to create two longitudinally extending regions within the bin-tray.

The components of the fastener locator system of this invention are illustrated in FIGS. 10, 11A, 11B and 12. To utilize the fastener locator system, an information card is provided for the purchaser at the location of the merchandising display. The information card contains the information shown on FIGS. 11A, 11B and 12. Referring to FIG. 11A, it can be seen that graphic representations are used to assist the purchaser in identifying various head styles, drive styles, thread styles, nuts, washers, and specialty type fasteners. The process therefore of identifying the appropriate tray 2 or bin tray 12 containing a desired fastener product requires that the purchaser first examine the graphic illustrations contained on the information card shown on FIGS. 11A and 11B. After locating the appropriate graphic illustration, the purchaser is able to read the common trade name of the fastener product. By then referring to the product listing, as shown in FIG. 12, the purchaser identifies a code associating the tray containing the fastener with an alphabetical symbol. The alphabetical symbol boldly appears on angularly extending flange 11 of tray 2 along with the graphic representation of the fastener product and its trade identification. A numerical code may also be used as an alternative code to identify a particular tray containing a particular fastener product.

To use the locator system, if a purchaser were desirous of purchasing a socket head cap screw not knowing the trade identification of the product, by examining the graphical representations on the information card, the thread style 72 for a cap screw would be recognized in FIG. 11A and a socket head style 73 would also be identifiable in FIG. 11A. By then referring to the product list on the information card, such as would be shown in FIG. 12, the term socket head cap screw is located. If the cap screw were metric, the purchaser would find that socket head cap screws metric are stored in trays J and K. If a numerical code were adopted the drawer information contained in FIG. 12 would be identified by numbers. Having ascertained the appropriate tray or bin-tray identification code, the purchaser locates the appropriate alphabetical letter or number displayed on angularly extending flange 11 of the tray or bin-tray to find the storage site of the particular fastener product.

Thus, a merchandising display and locator system has been described which permits the merchandiser to more efficiently utilize merchandising space while permitting greater visual access to the purchaser of fastener product information. The locator system allows the purchaser to locate a particular fastener product by referring to an information card associated with the merchandising display. The information card contains graphical representations to assist the purchaser to ascertain the trade identity of a particular fastener product which is coded to a tray or tray-bin.

While I have shown and described certain embodiments of the merchandising display and locator system, it is to be understood that it is subject to many modifications without departing from the spirit and scope of the claims as recited herein.

What is claimed is:

1. A merchandising display and locator system for enhanced visual access to fastener product information comprising:

(a) a housing having a cavity therein and a vertical axis and a horizontal axis, said housing having a truncated frontal surface angularly inclined to said vertical axis with an opening therein where said truncated frontal surface is laterally spaced from and essentially parallel to said horizontal axis and where said opening communicates with said cavity;

(b) a plurality of tray members adapted for slidable carriage by said housing, said housing having a multiplicity of slots extending therein in a direction lateral to said horizontal axis for receiving said tray members where said tray members are essentially parallel and spaced vertically in said cavity, each said tray member having a frontal end extending through said frontal surface in an ascending vertical direction at progressively shorter distances;

(c) a frontal flange extending in a direction essentially parallel to said horizontal axis and carried by each said tray member at said frontal end where said frontal flange is angularly inclined to said vertical axis to permit enhanced visual access to a purchaser;

(d) an information card for use in conjunction with said merchandising display having graphical representations of fastener indicia and trade name identification nomenclature associated with said fastener indicia, said information card having a listing of said fastener products by trade name identification nomenclature and a code symbol associated with each said trade name, where said code symbol is visually displayed on said frontal flange and said fastener product associated with said code symbol is carried by said tray member, whereby a purchaser by referring to said information card may identify said trade name nomenclature and said associated code symbol whereupon said purchaser may visually identify said tray member associated with said code symbol; and (e) a plurality of projecting connectors extending axially in a vertical direction from the outer surface of said housing and a plurality of receptor cavities contained in the outer surface of said housing where said receptor cavities are located axially opposite from said projecting connectors for forming a releasable lock to vertically tier said housing to a like dimensioned and designed housing such that each said frontal end will be in vertical alignment with the frontal end of the corresponding tray member contained in said like dimensioned and designed housing thereby permitting said purchaser to observe each said frontal flange at the same time.

2. The merchandising display and locator system recited in claim 1 wherein said housing is substantially box-shaped.

3. The merchandising display recited in claim 2 wherein said housing comprises a pair of substantially parallel sidewall members, a base member interconnecting said sidewall members, and a cover panel substantially parallel to said base member interconnecting said sidewall members.

4. The merchandising display and locator system recited in claim 3 further comprising a plurality of projecting connectors extending from the surface of one of said sidewall members, and a plurality of receptor cavities located in the outside surface of said other sidewall member for forming a releasable lock to horizontally tier said housing to a like dimensioned and designed housing.

5. The merchandising display and locator system recited in claim 1 wherein said graphical representations of fastener indicia comprise fastener product head styles, drive styles, thread styles, nuts, and washers.

6. The merchandising display and locator system recited in claim 1 wherein said code symbols are alphabetical letters.

7. The merchandising display and locator system recited in claim 1 wherein said truncated frontal surface is angularly inclined to said vertical axis at angle of approximately nine degrees.

8. A merchandising display and locator system for enhanced visual access to fastener product information comprising:

(a) a housing having a cavity therein and a vertical axis and a horizontal axis, said housing having a truncated frontal surface angularly inclined to said vertical axis with an opening therein where said truncated frontal surface is laterally spaced from and essentially parallel to said horizontal axis and where said opening communicates with said cavity;

(b) a plurality of tray members adapted for slidable carriage by said housing, said housing having a multiplicity of slots extending therein in a direction lateral to said horizontal axis for receiving said tray members where said tray members are essentially parallel and spaced vertically in said cavity, each said tray member having a frontal end extending through said frontal surface in an ascending vertical direction at progressively shorter distances;

(c) a frontal flange extending in a direction essentially parallel to said horizontal axis and carried by each said tray member at said frontal end where said frontal flange is angularly inclined to said vertical axis to permit enhanced visual access to a purchaser; and (d) a plurality of projecting connectors extending axially in a vertical direction from the outer surface of said housing and a plurality of receptor cavities contained in the outer surface of said housing where said receptor cavities are located axially opposite from said projecting connectors for forming a releasable lock to vertically tier said housing to a like dimensioned and designed housing such that each said frontal end will be in vertical alignment with the frontal end of the corresponding tray member contained in said like dimensioned and designed housing thereby permitting said purchaser to observe each said frontal flange at the same time.

9. The merchandising display system recited in claim 8 wherein said housing is substantially box-shaped.

10. The merchandising display system recited in claim 9 wherein said housing comprises a pair of substantially parallel sidewall members, a base member interconnecting said sidewall members, and a cover panel interconnecting said sidewall members and substantially parallel to said base member.

11. The merchandising display system recited in claim 10 further comprising a plurality of projecting connectors extending from the surface of one of said sidewall members, and a plurality of receptor cavities located in the outside surface of said other sidewall member for forming a releasable lock to horizontally tier said housing to a like dimensioned and designed housing.

12. The merchandising display and locator system recited in claim 8 wherein said truncated frontal surface is angularly inclined to said vertical axis at angle of approximately nine degrees.

13. A merchandising display and locator system for enhanced visual access to fastener product information comprising in combination:

(a) a housing having a cavity therein and a vertical axis and a horizontal axis, said housing having a truncated frontal surface with an opening therein where said truncated frontal surface is laterally spaced from and essentially parallel to said horizontal axis and angularly inclined to said vertical axis, said opening communicating with said cavity; a plurality of tray members adapted for slidable carriage by said housing, said housing having a multiplicity of slots extending therein in a direction lateral to said horizontal axis for receiving said tray members where said tray members are essentially parallel and spaced vertically in said cavity, each said tray member having a frontal end extending through said frontal surface in an ascending vertical direction at progressively shorter distances; each said tray member having a frontal flange extending in a direction essentially parallel to said horizontal axis and carried by each said tray member at said frontal end where said frontal flange is angularly inclined to said vertical axis to permit enhanced visual access to a purchaser; a plurality of projecting connectors extending axially in a vertical direction from the outer surface of said housing and a plurality of receptor cavities contained in the outer surface of said housing where said receptor cavities are located axially opposite from said projecting connectors for forming a releasable lock to vertically tier said housing to a like dimensioned and designed housing such that each said frontal end will be in vertical alignment with the frontal end of the corresponding tray member contained in said like dimensioned and designed housing thereby permitting said purchaser to observe each said frontal flange at the same time, and (b) an information card having graphical representations of fastener indicia and trade name identification nomenclature associated with said fastener indicia, said information card having a listing of said fastener products by trade name identification nomenclature, a code symbol associated with each said trade name, where said code symbol is visually displayed on said frontal flange and said fastener product associated with said code symbol is carried by said tray member, whereby a purchaser by referring to said information card may identify from said graphical representations of fastener indicia said trade name nomenclature and said code symbol whereupon said purchaser visually identifies said tray member associated with said code symbol.

14. The combination recited in claim 13 wherein said housing is substantially box-shaped.

15. The combination recited in claim 14 wherein a pair of substantially parallel sidewall members, a base member interconnecting said sidewall members, and a cover panel substantially parallel to said base member interconnecting said sidewall members.

16. The combination recited in claim 15 further comprising a plurality of projecting connectors extending from the surface of one of said sidewall members, and a plurality of receptor cavities located in the outside surface of said other sidewall member for forming a releasable lock to horizontally tier said housing to a like dimensioned and designed housing.

17. The combination recited in claim 13 wherein said graphical representations of fastener indicia comprise fastener product head styles, drive styles, thread styles, nuts and washers.

18. The combination recited in claim 13 wherein said code symbols are alphabetical letters.

19. The combination recited in claim 13 wherein said truncated frontal surface is angularly inclined to said vertical axis at angle of approximately nine degrees.

* * * * *